US011608146B2

(12) United States Patent
Lyon et al.

(10) Patent No.: US 11,608,146 B2
(45) Date of Patent: Mar. 21, 2023

(54) QUICK RELEASE MAST MOUNTING ASSEMBLIES FOR HYDROFOIL SPORTS BOARDS

(71) Applicant: BI-THERMAL ASPEN EARTH, L.L.C., Salt Lake City, UT (US)

(72) Inventors: Tyler Lyon, Salt Lake City, UT (US); Aaron Best, Salt Lake City, UT (US)

(73) Assignee: Bi-Thermal Aspen Earth, L.L.C., Salt Lake City, UT (US)

( * ) Notice: Subject to any disclaimer, the term of this patent is extended or adjusted under 35 U.S.C. 154(b) by 27 days.

(21) Appl. No.: 17/193,501

(22) Filed: Mar. 5, 2021

(65) Prior Publication Data

US 2021/0347441 A1 Nov. 11, 2021

Related U.S. Application Data

(60) Provisional application No. 62/986,062, filed on Mar. 6, 2020.

(51) Int. Cl.

| | |
|---|---|
| ***B63B 32/66*** | (2020.01) |
| ***B63B 1/24*** | (2020.01) |
| ***B63B 32/50*** | (2020.01) |

(52) U.S. Cl.

CPC ..... *B63B 32/66* (2020.02); *B63B 1/242* (2013.01); *B63B 1/248* (2013.01); *B63B 32/50* (2020.02)

(58) Field of Classification Search

CPC ..... B63B 1/242; B63B 1/248; B63B 32/50; B63B 32/60; B63B 32/64; B63B 32/66

See application file for complete search history.

(56) References Cited

U.S. PATENT DOCUMENTS

| | | | | |
|---|---|---|---|---|
| 9,643,695 | B1 * | 5/2017 | Breaux | B63B 32/66 |
| 9,856,000 | B1 * | 1/2018 | Midler | B63B 32/70 |
| 10,773,775 | B2 * | 9/2020 | Stehlik | B63B 32/60 |
| 11,148,763 | B2 * | 10/2021 | Moltrup | B63B 32/66 |
| 2002/0111094 | A1 * | 8/2002 | Jensen | A63C 10/16 280/611 |
| 2021/0114691 | A1 * | 4/2021 | Harmon | B63B 32/66 |

FOREIGN PATENT DOCUMENTS

| | | | | |
|---|---|---|---|---|
| KR | 102231086 | B1 * | 3/2022 | B63B 32/10 |

* cited by examiner

*Primary Examiner* — Ajay Vasudeva
(74) *Attorney, Agent, or Firm* — Bretton L. Crockett; TechLaw Ventures, PLLC

(57) ABSTRACT

This disclosure extends to systems, apparatus, and methods for quick release mast mounting assemblies for board mounted hydrofoil assemblies. In one exemplary system, a quick release mounting assembly may include board mountable base receiver for mounting to a sports board, which defines a longitudinal receiving recess. A resilient locking member is disposed at a front end of the base receiver. A separate mast connection member formed as a body configured for connection to an upper end of a hydrofoil mast, corresponds to the longitudinal receiving recess, and includes a counterpart structure for forming a secure connection with the resilient locking member. The mast connection member may include opposite shoulder or wing members that extend laterally orthogonal to the longitudinal axis thereof and the receiving recess may include counterpart slots for receiving these members. The resilient locking member may include a separate spring assembly or be a unitary member.

20 Claims, 3 Drawing Sheets

QUICK RELEASE MAST MOUNTING ASSEMBLIES FOR HYDROFOIL SPORTS BOARDS

CROSS-REFERENCE TO RELATED APPLICATION

This application claims the benefit of U.S. Provisional Application No. 62/986,062, filed Mar. 6, 2020, which is incorporated herein by reference in its entirety, including but not limited to those portions that specifically appear hereinafter.

BACKGROUND

The disclosure relates generally to methods, systems, and devices for the mounting of hydrofoil assemblies to sports boards. Many current hydrofoil surfboards and water skis include front and rear planing blades, both disposed parallel to the elongate main board, on the front and rear of a support member attached to a mast extending downwards from the board. Often, the mast is mounted to the board using multiple screws passing through a mounting plate at a top end thereof. Such boards must be stored and transported with the mast installed, or a user must have a tool to remove the mast. Attempts to implement "quick release" systems typically have used one or more hooks on plate disposed at the top of the mast that slide over rods mounted on the board and then secure in place using one or more thumbscrews or other fasteners, which can increase drag during use.

A quick release mast mounting assembly that securely retains a mast in position to a board, but does not require a separate tool, or fastener for securing in place would be an improvement in the art.

SUMMARY

This disclosure extends to systems, apparatus, and methods for quick release mast mounting assemblies for board mounted hydrofoil assemblies. In one exemplary system, a quick release mounting assembly may include board mountable base receiver for mounting to a sports board, which defines a longitudinal receiving recess. A resilient locking member is disposed at a front end of the base receiver. A separate mast connection member formed as a body configured for connection to an upper end of a hydrofoil mast, corresponds to the longitudinal receiving recess, and includes a counterpart structure for forming a secure connection with the resilient locking member. The mast connection member may include opposite shoulder or wing members that extend laterally orthogonal to the longitudinal axis thereof and the receiving recess may include counterpart slots for receiving these members. The resilient locking member may include a separate spring assembly or be a unitary member.

The features and advantages of the disclosure will be set forth in the description, which follows, and in part will be apparent from the description, or may be learned by the practice of the disclosure without undue experimentation. The features and advantages of the disclosure may be realized and obtained by means of the instruments and combinations particularly pointed out in the appended claims. Any discussion of documents, acts, materials, devices, articles or the like, which has been included in the specification is not to be taken as an admission that any or all these matters form part of the prior art base, or were common general knowledge in the field relevant to the disclosure as it existed before the priority date of each claim of this disclosure.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where:

FIGS. 2A and 2B are enlarged views of portions of FIG. 2 illustrating securing portions of the components of the assembly.

DETAILED DESCRIPTION

Figure 1:
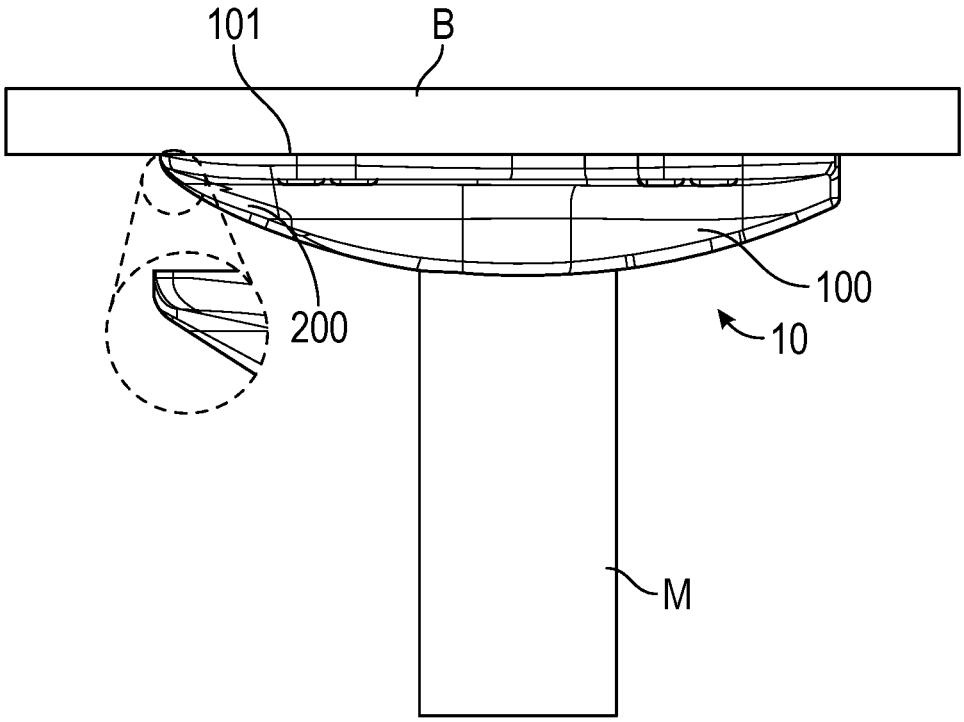
FIG. 1 illustrates an assembled side view of a first illustrative embodiment of a hydrofoil mast quick release assembly for use with a waterski or surfboard system in an assembled configuration on a board.
Figure 2:
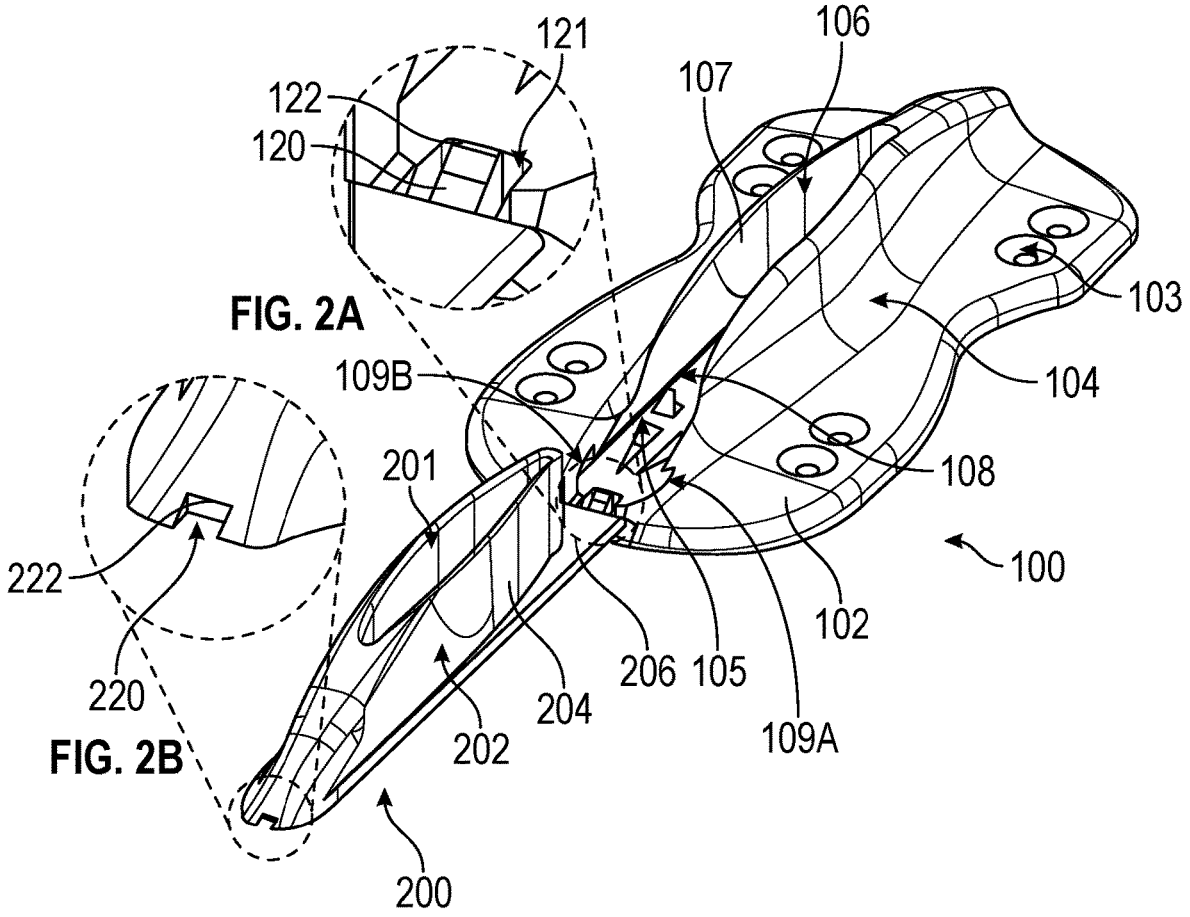
FIG. 2 illustrates an exploded front isometric view of the components of the quick release assembly of FIG. 1 in isolation.

The disclosure extends to methods, systems, and devices for hydrofoil assemblies allowing for the secure attachment and "quick release" of the mast and planing portions from a sports board. In the following description of the disclosure, reference is made to the accompanying drawings, which form a part hereof, and in which is shown by way of illustration specific implementations in which the disclosure may be practiced. It is understood that other implementations may be utilized, and structural changes may be made without departing from the scope of the disclosure.

Before the methods, systems and devices of the present disclosure are discussed and described, it is to be understood that this disclosure is not limited to the particular configurations, process steps, and materials disclosed herein as such configurations, process steps, and materials may vary somewhat. It is also to be understood that the terminology employed herein is used for the purpose of describing implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

A first example of an embodiment of a hydrofoil mast quick release assembly 10 for use with a waterski or surfboard system in accordance with the teachings of the present disclosure is depicted in FIGS. 1, 2, 2A, and 2B. Quick release mounting assembly 10 may include board mountable base receiver 100 for mounting to a sports board B, and a separate mast connection member 200 for connection to an upper end of a hydrofoil mast M.

Base receiver 100 may be formed as a body with a first surface 101 that is configured to correspond to the bottom surface of a sports board, such as body board, waterski, surfboard or the like. On an opposite side, a central body 104 extends away from a planar base section 102, which may contain a plurality of connection ports 103 allowing screws or other fasteners to be used to connect the base 100 to the sports board B. The central body has a longitudinal axis, which upon installation to a sports board is parallel to the long axis of the sports board. A longitudinal receiving recess 106 is formed in the central body 104, having an open front end 105, a closed rear and opposite sidewalls 107. One or more slots 108, may be formed in the sidewalls 107 and have front openings, such as the depicted two openings 109A and 109B. A resilient locking member 120 is disposed at a front end of the base receiver in line with the receiving recess, as discussed in more detail further herein.

A separate mast connection member 200 may be formed as a body configured for connection to an upper end of a hydrofoil mast M. In the depicted embodiment, a mast recess 201 (FIG. 2) is shaped to correspond to a hydrofoil mast, which may be secured therein in any suitable fashion known in the art, to extend orthogonally from the sports board upon assembly (as depicted in FIG. 1) to extend to a suitable fuselage and/or plane arrangement. The mast connection member may have a body 202 defining sidewalls 204, which correspond to sidewalls 107 of the receiving recess of the base 100. The mast connection member may further include shoulders or wing members that extend laterally away from the longitudinal axis of the body. In the depicted embodiment, the wing members may be formed as a planar portion 206 extending rearwards and sideward from the body 202. At a front end, the mast connection member 200 includes a securing structure 220 for forming a secure connection with the resilient locking member 120.

As depicted in more detail in FIGS. 2A and 2B, the resilient locking member 120 may be formed as a member with a rounded abutting surface 122 and a body section 124, disposed in a recess 121, which is biased to move the abutting surface 122 of the locking member in a direction away from the first surface 101 of the base towards and past the opposite side surface. In the depicted embodiment, the locking member 120 may be formed as a unitary member, which may be continuous with the remainder of the base 100, and the bias provided by the properties thereof, as through injection molding of suitable material. Securing structure 220 may be formed as a notch in the front surface of the mast connection member 200, which has a curved rear wall 222, corresponding to the curved abutting surface 122 of the locking member 120.

For installation, the rear of the mast connection member 200 is slidably inserted into the open front of the receiving recess 106, with the counterpart slots 108 receiving the lateral members 206. The locking member 120 is depressed into recess 121 as the mast connection member is inserted, until notch 220 passes thereover, allowing the locking member 120 to bias out of recess 121 until abutting surface 122 contacts curved rear wall 222, thereby securing the mast connection member in place. As depicted in FIG. 1, the complete assembly may have curved smooth surfaces to reduce drag during use. After use, the locking member 120 may be depressed by a user, as by pressing with the thumb or fingers, to move away from rear wall 222, allowing the mast connection member 200 to be slidably removed from the recess 106.

During use, the forces generated by the movement of the board forwards in the water press rearwards on the mast connection member, keeping the assembly 10 secured. The lateral extensions 206 and counterpart slots 108 provide reinforcement and securing to withstand lateral and twisting forces on the mast. It will be appreciated that in addition to the depicted lateral "wings" in FIGS. 1 and 2, that other suitable structures may be used. For example, assemblies where the mast connection member has multiple lateral extensions at different levels, or a body with wide "shoulders" rather than "wings" may be used with suitably formed counterpart receiving base members. It will be further appreciated that a mast connection member formed as a flared body that inserts into a correspondingly shaped mating recess may also be used. Additionally, other locking arrangements, such as an insertable pin or other suitable securing mechanisms known to those of skill in the art may be used.

Figure 3:
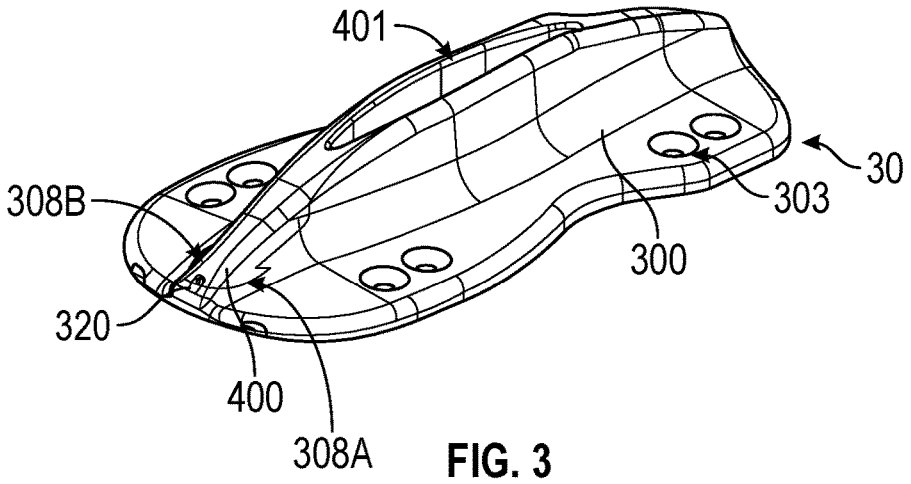
FIG. 3 illustrates an isometric view of a second illustrative embodiment of a hydrofoil mast quick release assembly for use with a waterski or surfboard system in an assembled configuration.
Figure 4:
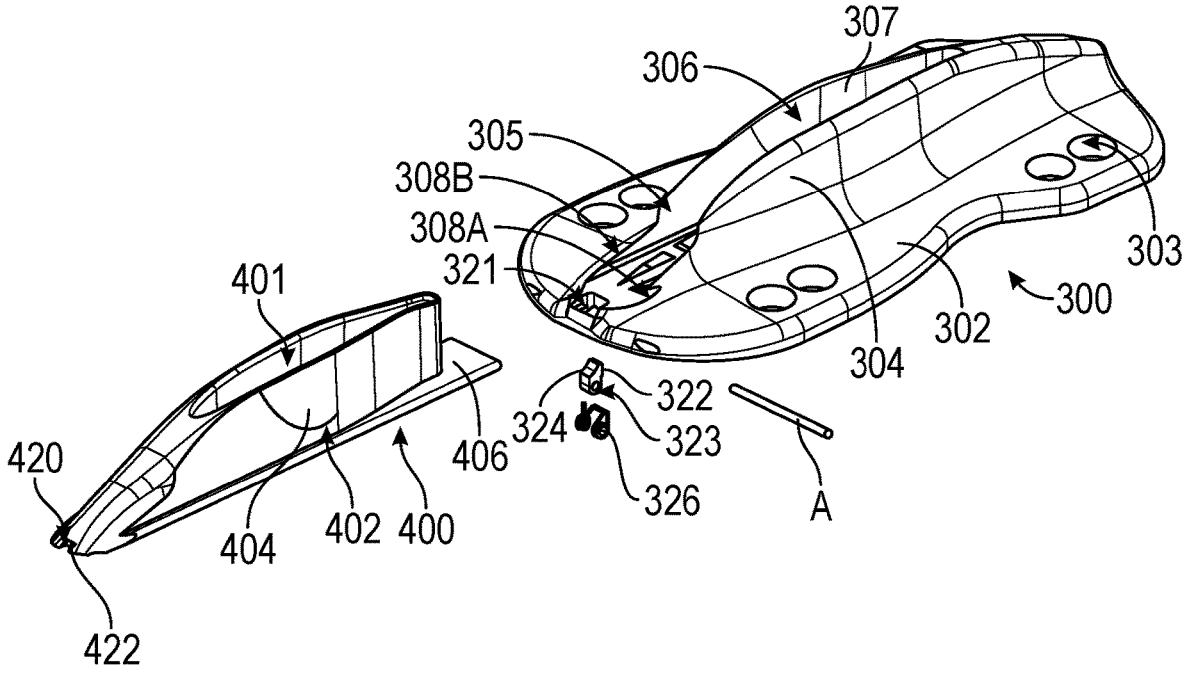
FIG. 4 illustrates an exploded view of the components of FIG. 3.
Figure 5:
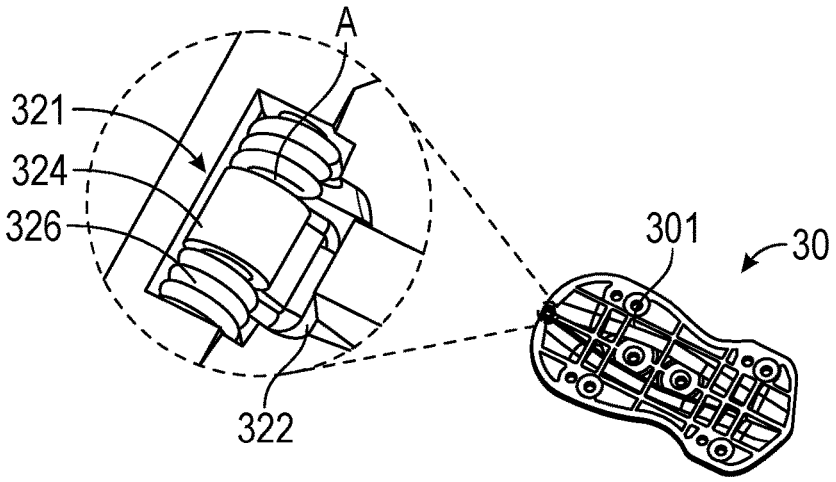
FIG. 5 is a bottom view with an enlarged view of a portion illustrating securing portions of the components of the assembly of FIGS. 3 and 4.

Turning to FIGS. 3, 4 and 5, a second exemplary embodiment of a hydrofoil mast quick release assembly 30 for use with a waterski or surfboard in accordance with the teachings of the present disclosure is depicted. Quick release mounting assembly 10 may include board mountable base receiver 300 for mounting to a sports board, and, a separate mast connection member 400 for connection to an upper end of a hydrofoil mast.

Base receiver 300 may be formed as a body with a first surface 301 that is configured to correspond to the bottom surface of a sports board, such as body board, waterski, surfboard or the like. On an opposite side, a central body 304 extends away from a planar base section 302, which may contain a plurality of connection ports 303 allowing screws or other fasteners to be used to connect the base 300 to the sports board. The central body has a longitudinal axis, which upon installation to a sports board is parallel to the long axis of the sports board. A longitudinal receiving recess 306 is formed in the central body 304, having an open front end 305, a closed rear and opposite sidewalls 307. One or more slots, such as counterpart lateral slots 308A and 308B, may be formed in the sidewalls 307. A resilient locking tab 320 is disposed at a front end of the base receiver in line with the receiving recess, as discussed in more detail further herein.

A separate mast connection member 400 formed as a body configured for connection to an upper end of a hydrofoil mast. In the depicted embodiment, a mast recess 401 is shaped to correspond to a hydrofoil mast, which may be secured therein in any suitable fashion known in the art, to extend orthogonally from the sports board upon assembly. The mast connection member may have a body 402 defining sidewalls 404, which correspond to sidewalls 307 of the receiving recess 306. The mast connection member 400 may further include shoulders or wing members that extend laterally away from the longitudinal axis of the body. In the depicted embodiment, the wing members may be formed as a planar portion 406 extending rearwards and sideward from the body 402. At a front end, the mast connection member 400 includes a securing structure 420 for forming a secure connection with the resilient locking tab 320.

As depicted in more detail in FIGS. 4 and 5, the resilient locking tab 320 may be formed as a locking member 324 with a rounded abutting surface 322 and a rounded axle recess 323. Upon installation, the locking tab 324 is disposed in a recess 321, secured therein by placement on an axle A, and using a spring assembly 326 to bias the locking member to move the abutting surface 322 thereof in a direction away from the first surface 101 of the base towards and past the opposite side surface. Securing structure 420 may be formed as a notch in the front surface of the mast connection member 400, which has a curved rear wall 422, corresponding to the curved abutting surface 322.

For installation, the rear of the mast connection member 400 is slidably inserted into the open front 305 of the receiving recess 306, with the counterpart slots 308A and 308B receiving the lateral members 406. The locking tab 320 is depressed into recess 321 as the mast connection member is inserted, until notch 420 passes thereover, allowing the locking tab 320 to bias out of recess 321 until abutting surface 322 contacts curved rear wall 422, thereby securing the mast connection member in place. As depicted in FIG. 3, the complete assembly has curved smooth surfaces to reduce drag during use. After use, the locking tab 320 may be depressed by a user, as by pressing with the thumb or fingers, to move away from rear wall 422, allowing the mast connection member 400 to be slidably removed from the recess 306.

It will be appreciated that in addition to the specific depictions of resilient locking members as including a separate spring assembly rotating a body around and axle, and unitary members formed joined to the base assembly, that other variations are possible using different springs and biasing mechanisms.

It will be further appreciated that the components of the quick release mast connection assemblies in accordance with the present disclosure may be formed from any suitable material having sufficient strength and durability to serve during the intended use. For example, glass-filled nylon which is injection molded into the desired shapes could be used.

In the foregoing Detailed Description, various features of the disclosure are grouped together in a single implementation for streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed implementation. Thus, the following claims are hereby incorporated into this Detailed Description by this reference, with each claim standing on its own as a separate implementation of the disclosure.

It will be further appreciated that the embodiments depicted and discussed in this disclosure are exemplary rather than limiting. It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A quick release mast mounting assembly for a board mounted hydrofoil assembly, comprising:

a base receiver for mounting to a sports board, the base receiver having a central body extending from a base section, a longitudinal receiving recess disposed on the central body, the longitudinal recess extending along a length of the central body from a front opening, wherein the longitudinal receiving recess includes a first lateral slot extending into the central body in a direction other than the extension of the central body from the base section and a second lateral slot extending into the central body of the base receiver, and a locking member disposed at a front end of the base receiver aligned with the longitudinal receiving recess; and a mast connection member formed as a body configured for connection to an upper end of a hydrofoil mast and including at least one hydrofoil mast connection port, wherein at least a rear portion of the mast connection member corresponds to the longitudinal receiving recess, and wherein a front portion includes a securing structure for forming a secure connection with the locking member.

2. The quick release mast mounting assembly of claim 1, wherein the first lateral slot is formed in a first sidewall of the longitudinal receiving recess and extends to a first front opening on the base receiver.

3. The quick release mast mounting assembly of claim 1, wherein the first lateral slot extends into the central body in a direction parallel to a mounting surface of the base section.

4. The quick release mast mounting assembly of claim 1, wherein the mast connection member further comprises at least one lateral member that extends laterally in a direction orthogonal to a longitudinal axis of the hydrofoil mast connection port, the at least one lateral member corresponding to the first lateral slot, such that the at least one lateral member resides in the first lateral slot when the mast connection member is received in the base receiver.

5. The quick release mast mounting assembly of claim 4, wherein the mast connection member further comprises a second lateral member that extends laterally in a direction orthogonal to a longitudinal axis of the hydrofoil mast connection port on the mast connection member, the second lateral member corresponding to the second lateral slot, such that the second lateral member resides in the second lateral slot when the mast connection member is received in the base receiver.

6. The quick release mast mounting assembly of claim 5, wherein the mast connection member further comprises a generally planar rear section as unitary body with the at least first lateral member and the second lateral member defining opposite sides of the unitary body.

7. The quick release mast mounting assembly of claim 1, wherein the second lateral slot is formed in a second sidewall of the longitudinal receiving recess and extends to a second front opening on the base receiver.

8. The quick release mast mounting assembly of claim 1, wherein the locking member comprises a resilient locking member formed as a unitary extension of the base member.

9. The quick release mast mounting assembly of claim 1, wherein the locking member comprises includes a spring assembly.

10. The quick release mast mounting assembly of claim 1, wherein the mast connection member further comprises a socket for receiving the upper end of a hydrofoil mast and the hydrofoil mast is secured in the socket.

11. A hydrofoil assembly, comprising:

a sports board;

a base receiver disposed on the sports board, the base receiver having a central body extending from a base section, a longitudinal receiving recess disposed on the central body, the longitudinal recess extending along a length of the central body from a front opening, and a locking member disposed at a front end of the base receiver aligned with the longitudinal receiving recess, wherein the longitudinal receiving recess includes a first lateral slot extending into the central body in a direction other than the extension of the central body from the base section and a second lateral slot extending into the central body of the base receiver;

a mast connection member wherein at least a rear portion of the mast connection member corresponds to the longitudinal receiving recess, and wherein a front portion includes a securing structure for forming a secure connection with the locking member; and a hydrofoil mast extending from the mast connection member.

12. The hydrofoil assembly of claim 11, wherein the first lateral slot is formed in a first sidewall of the longitudinal receiving recess and extends to a first front opening on the base receiver.

13. The hydrofoil assembly of claim 11, wherein the first lateral slot extends into the central body in a direction parallel to a mounting surface of the base section.

14. The hydrofoil assembly of claim 11, wherein the mast connection member further comprises at least one lateral member that extends laterally in a direction orthogonal to a longitudinal axis of the hydrofoil mast connection port, the at least one lateral member corresponding to the first lateral slot, such that the at least one lateral member resides in the first lateral slot when the mast connection member is received in the base receiver.

15. The hydrofoil assembly of claim 14, wherein the mast connection member further comprises a second lateral member that extends laterally in a direction orthogonal to a longitudinal axis of the hydrofoil mast connection port on the mast connection member, the second lateral member corresponding to the second lateral slot, such that the second lateral member resides in the second lateral slot when the mast connection member is received in the base receiver.

16. The hydrofoil assembly of claim 15, wherein the mast connection member further comprises a generally planar rear section as unitary body with the at least first lateral member and the second lateral member defining opposite sides of the unitary body.

17. The hydrofoil assembly of claim 11, wherein the second lateral slot is formed in a second sidewall of the longitudinal receiving recess and extends to a second front opening on the base receiver.

18. The hydrofoil assembly of claim 11, wherein the locking member comprises a resilient locking member formed as a unitary extension of the base member.

19. The hydrofoil assembly of claim 11, wherein the locking member comprises includes a spring assembly.

20. The hydrofoil assembly of claim 11, wherein the mast connection member further comprises a socket for receiving the upper end of a hydrofoil mast and the hydrofoil mast is secured in the socket.

* * * * *